US011097136B2

(12) United States Patent
Malcolm

(10) Patent No.: US 11,097,136 B2
(45) **Date of Patent: *Aug. 24, 2021**

(54) HIGH LOAD DESCENDER WITH ADAPTIVE RELEASE LINKAGE

(71) Applicant: Harken, Incorporated, Pewaukee, WI (US)

(72) Inventor: Jonathan D. Malcolm, Wales, WI (US)

(73) Assignee: Harken, Incorporated, Pewaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/148,161

(22) Filed: Oct. 1, 2018

(65) Prior Publication Data

US 2019/0030376 A1 Jan. 31, 2019

Related U.S. Application Data

(63) Continuation of application No. 15/093,317, filed on Apr. 7, 2016, now Pat. No. 10,092,781.

(60) Provisional application No. 62/144,260, filed on Apr. 7, 2015.

(51) Int. Cl.
*A62B 1/14* (2006.01)
*A62B 35/00* (2006.01)

(52) U.S. Cl.
CPC ..... *A62B 1/14* (2013.01); *A62B 35/005* (2013.01)

(58) Field of Classification Search
CPC ..... F16D 63/008; A63B 27/00; A63B 27/02; A63B 27/04; A63B 29/02; A62B 35/005; A62B 35/0068; A62B 35/0075; A62B 35/0081; A62B 35/0093; A62B 1/14; A62B 1/06
USPC ..... 188/65.5
See application file for complete search history.

(56) References Cited

U.S. PATENT DOCUMENTS

| | | | | |
|---|---|---|---|---|
| 3,150,744 | A | 9/1964 | Fertier | |
| 4,487,292 | A | 12/1984 | Smith | |
| 4,511,123 | A | 4/1985 | Ostrobrod | |
| 5,217,084 | A | 6/1993 | Olson | |
| 5,305,852 | A | 4/1994 | Klokseth | |
| 5,343,976 | A | 9/1994 | Ostrobrod | |
| 5,577,576 | A * | 11/1996 | Petzl | A62B 1/14 188/65.4 |

(Continued)

FOREIGN PATENT DOCUMENTS

| | | |
|---|---|---|
| GB | 2290852 | 1/1996 |
| WO | WO2010049597 | 5/2010 |

(Continued)

OTHER PUBLICATIONS

Search report for PCT/US16/26491; dated Jul. 7, 2016.
European Search Report for Application No. 16777298.7-1113 / 3280499 PCT/US2016026491; dated Oct. 19, 2018.

*Primary Examiner* — Daniel P Cahn
(74) *Attorney, Agent, or Firm* — Brian G. Gilpin; Godfrey & Kahn, S.C.

(57) ABSTRACT

A high load descender for rope access and rescue has a ratcheting sheave mounted to a pivoting arm, which translate with rope tension against a fixed shoe. The ratcheting sheave has a groove that grips rope during descent while allowing free rotation for ascent and progress capture. An adaptive release linkage enhances ease of operation and control while maintaining convenient handle position in a variety of conditions.

8 Claims, 18 Drawing Sheets

(56) References Cited

U.S. PATENT DOCUMENTS

| | | | | |
|---|---|---|---|---|
| 6,446,936 | B1 | 9/2002 | Ostrobrod | |
| 7,658,264 | B2 | 2/2010 | Mauthner | |
| 7,845,467 | B2 | 12/2010 | Petzl | |
| 9,764,172 | B2 | 9/2017 | Wolner | |
| 10,035,028 | B1 * | 7/2018 | Siegel | A62B 1/06 |
| 10,092,781 | B2 * | 10/2018 | Malcolm | A62B 1/14 |
| 10,384,083 | B2 * | 8/2019 | Bell | A62B 1/20 |
| 10,583,315 | B2 * | 3/2020 | Malcolm | A63B 29/02 |
| 2002/0017428 | A1 | 2/2002 | Mauthner | |
| 2005/0082115 | A1 | 4/2005 | Petzl | |
| 2006/0207829 | A1 | 9/2006 | Mauthner | |
| 2007/0215411 | A1 | 9/2007 | Petzl | |
| 2008/0128221 | A1 | 6/2008 | Rogge | |
| 2009/0026023 | A1 * | 1/2009 | Petzl | A62B 1/14 188/65.4 |
| 2009/0120720 | A1 | 5/2009 | Arms | |
| 2011/0073417 | A1 * | 3/2011 | Chaumontet | A62B 1/14 188/65.5 |
| 2011/0174914 | A1 | 7/2011 | Yang | |
| 2012/0103725 | A1 | 5/2012 | Johansson | |
| 2012/0193166 | A1 | 8/2012 | Rogelja | |
| 2013/0032433 | A1 | 2/2013 | Codega | |
| 2013/0062145 | A1 | 3/2013 | Inoue | |
| 2013/0180800 | A1 | 7/2013 | Mauthner | |
| 2014/0196985 | A1 | 7/2014 | Moine | |
| 2014/0262610 | A1 | 9/2014 | Oddou et al. | |
| 2014/0262611 | A1 | 9/2014 | Oddou | |
| 2016/0228730 | A1 | 8/2016 | Chaumontet | |
| 2016/0310767 | A1 | 10/2016 | Resch | |
| 2017/0106216 | A1 | 4/2017 | Ollivier | |

FOREIGN PATENT DOCUMENTS

| | | |
|---|---|---|
| WO | WO2011042571 | 4/2011 |
| WO | WO2015044141 | 4/2015 |

* cited by examiner

HIGH LOAD DESCENDER WITH ADAPTIVE RELEASE LINKAGE

CROSS-REFERENCE TO RELATED APPLICATION AND PRIORITY CLAIM

This application is based on and claims priority to U.S. Provisional Patent Application No. 62/144,260 filed on Apr. 7, 2015 and U.S. patent application Ser. No. 15/093,317 filed on Apr. 7, 2016, which are incorporated herein by reference in their entirety for all purposes.

FIELD OF THE INVENTION

The present invention relates generally to the field of rope access and rescue. More particularly, the present invention relates to a descender that is typically attached to an operator's harness to allow controlled descent down a fixed rope. Descenders may be used in other applications that require holding and controlled release of a rope under load.

BACKGROUND

Descenders are widely used in the field of rope access and rescue for controlling the descent of people or equipment suspended by rope. Descenders are commonly used by operators to descend down a rope that is affixed overhead. Descenders may also be attached to an anchor position to allow an operator to control the descent of one or more people or gear from a remote location. Typically, descenders are comprised of elements that clamp or pinch the rope and are self-energized by load applied to the rope in one direction through the device. Controlled release is typically achieved by actuation of a lever which alleviates the clamping force holding the rope, allowing controlled release of rope through the device. Under certain circumstances it is necessary to pull rope through the descender, thereby reversing the direction of travel. In these cases the descender serves as a turning point for the rope and a means of progress capture.

Descenders commonly incorporate a "panic" safety feature such that if the means of release is inadvertently actuated too far, the descender will cease the release of rope, preventing an uncontrolled freefall of the suspended persons or equipment.

Descenders that are currently available have some recognized limitations. Compact descenders of the type that would be worn on a harness do not excel at handling the greater loads involved with a two person descent, as is common in a rescue situation. The maximum working load specification of commonly available descenders does not accommodate requirements of two person rescue, or requires additional hardware to configure the device for high loads. The effort required to initiate release at higher loads is difficult, and controllability is diminished. At these higher loads, descenders commonly have the undesirable effect of flattening the rope or milking the rope sheath due to the aggressive localized pinching employed to grip the rope. Additionally, compromises made to make the device perform well over a wide range of loads contribute to poor performance at low loads. For example, a user may find difficulty initiating descent of a light weight load due to high friction in the device, or may find that the release is initiated at a handle position very near the point of panic relock, making operation frustrating.

As such, there is a need for a compact descender capable of managing a large range of loads while maintaining easy and controlled release.

SUMMARY

A descender for controlling descent of a load along a rope includes a chassis and an opening plate pivotably attached to the chassis. A generally circular sheave having a groove around its circumference is attached to one end of a pivot arm. The other end of the pivot arm is pivotably attached to the chassis. Each of a guide and a shoe are attached to the chassis and are positioned on substantially opposite sides of the sheave.

When the opening plate is in an open position, the rope may be installed by inserting the rope past the guide, around a significant portion of the circumference of the sheave, and past the shoe. When the opening plate is in a closed position, a path for a rope is formed through the descender such that the rope slides against the guide and shoe, and is selectively forced into the groove on the sheave. The second end of the pivot arm is biased toward the shoe so that when the rope is in tension, the sheave is rotated toward the shoe, trapping the rope there between.

A handle is attached to the chassis and engaged with the pivot arm such that movement of the handle controls the amount of force biasing the pivot arm against the shoe, which allows a user to selectively reduce the force between them. By reducing the force between the sheave and the shoe, the tension of the rope is able to overcome frictional force holding the descender in place, thus allowing the descender to move along the rope.

An attachment hole is provided that passes through the chassis and the opening plate such that when the opening plate is in the closed position, an operator can lock the descender in the closed position by inserting any suitable attachment means through the attachment hole, including but not limited to a carabiner.

It will be understood by those skilled in the art that one or more aspects of this invention can meet certain objectives, while one or more other aspects can lead to certain other objectives. Other objects, features, benefits and advantages of the present invention will be apparent in this summary and descriptions of the disclosed embodiment, and will be readily apparent to those skilled in the art. Such objects, features, benefits and advantages will be apparent from the above as taken in conjunction with the accompanying figures and all reasonable inferences to be drawn therefrom.

DETAILED DESCRIPTION

Figure 1:
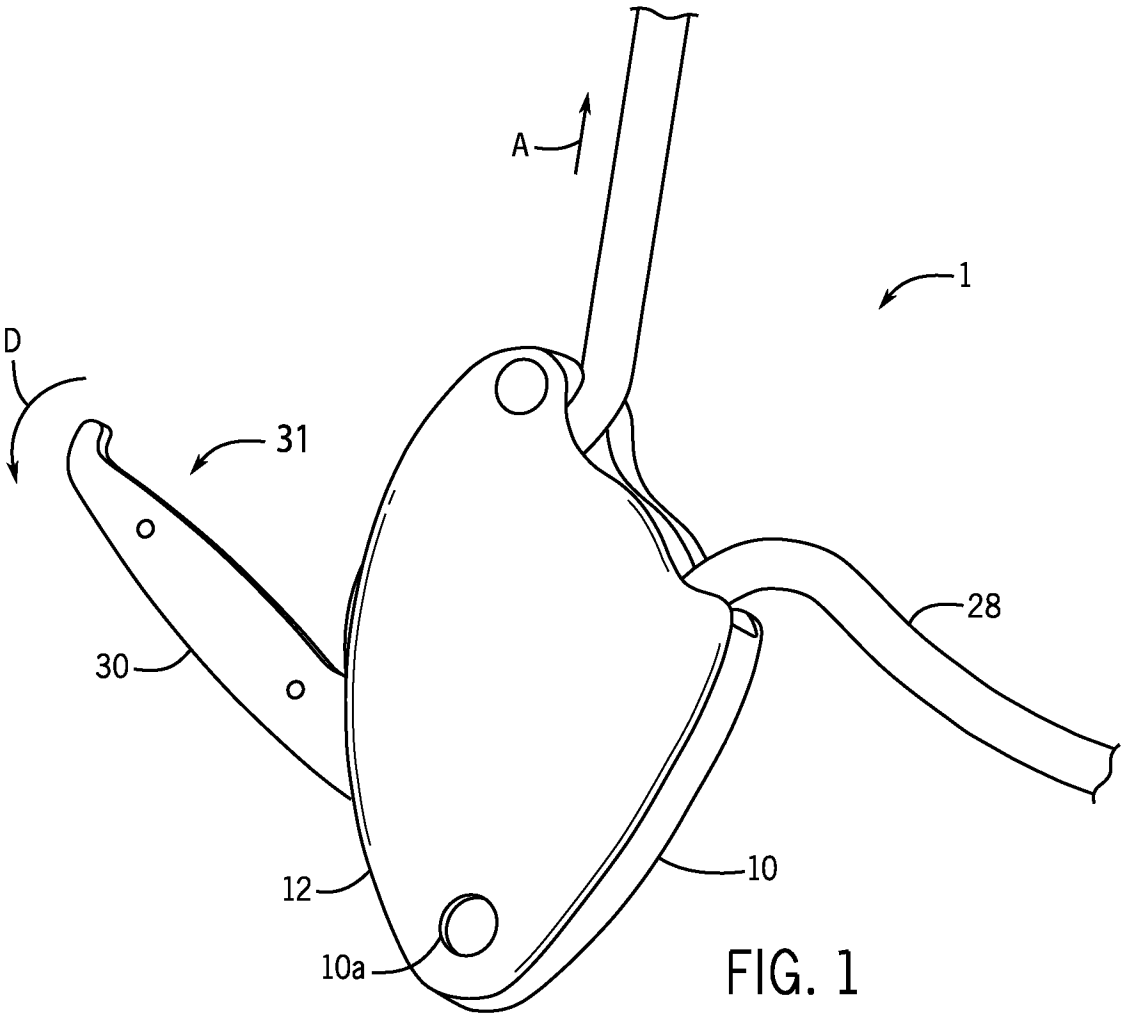
FIG. 1 is a perspective view of one embodiment of a descender in accordance with the invention, showing a rope installed as would be seen by an operator in use.

As shown in FIG. 1, the present invention is a descender 1 having a chassis 10, which together with swing plate 12 contain rope 28. Rope 28 is reeved such that a load to be managed pulls in direction A. Swing plate 12 is pivotably attached to chassis 10, which allows a user to rig the descender 1. Hole 10*a* provides a means of attachment, typically accomplished with a carabiner, but any other suitable attachment may alternatively be used. Hole 10*a* passes through the swing plate 12 and the chassis 10 so that when descender 1 is in use and a carabiner or other attachment means is in use, the swing plate 12 cannot open. Handle subassembly 31 is pivotally mounted to chassis 10 and comprises at least one handle member 30. In the embodiment shown, handle subassembly 31 includes two handle members 30 that are attached to each other to enclose components described in detail below. An operator can control the release of rope 28 by rotating handle subassembly 31 in direction D.

Figure 2:
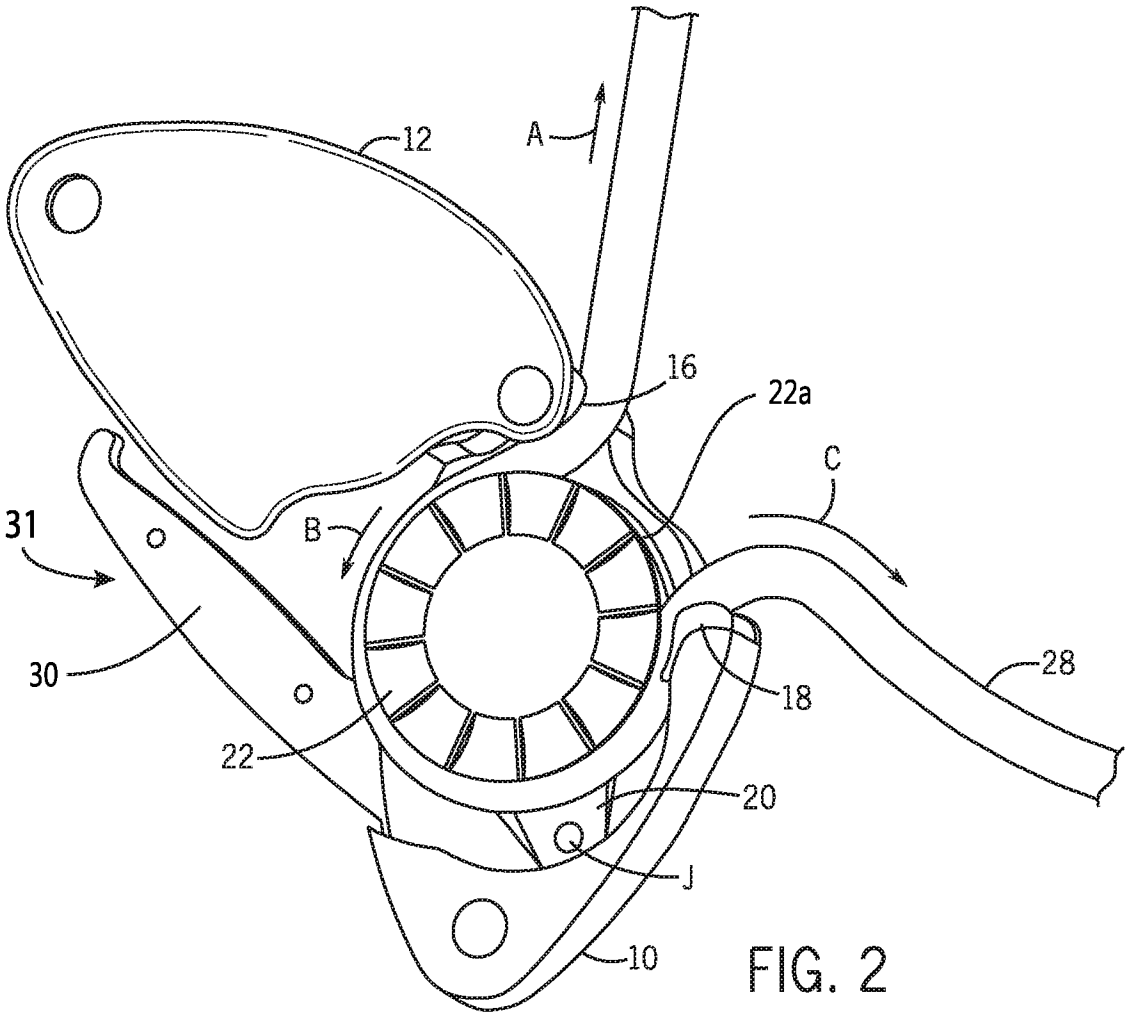
FIG. 2 is another perspective view of the descender of FIG. 1, with a swing plate open.

FIG. 2 shows descender 1 with swing plate 12 pivoted to an open position, which is only made possible if there is no attachment means passing through hole 10*a*. Sheave 22 has an acutely V-shaped groove 22*a* about its circumference that enhances the frictional interface between rope 28 and sheave 22 as tension is applied to rope 28. Sheave 22 is rotatably mounted to pivot arm 20 and has a one-way ratchet which only allows rotation in one direction. In the embodiment shown in FIG. 2, the ratchet allows rotation in direction B. In this embodiment, one-way rotation of sheave 22 is achieved by a pawl that engages teeth integrally formed in sheave 22. Of course, any suitable ratchet or backstopping clutch that only allows rotation of sheave 22 in direction B relative to pivot arm 20 may be used without departing from the invention. The one-way rotation of sheave 22 enables the descender 1 to act as an efficient pulley if ascent is required because free movement of sheave 22 in direction B means that the frictional forces between sheave 22 and rope 28 need not be overcome.

As shown in FIG. 2 a user may install rope 28 by inserting the rope into the chassis 10 at guide 16 and wrapping the rope around sheave 22, and exiting the chassis at shoe 18. Pivot arm 20 constrains motion of the sheave 22 such that the resultant force of the rope on the sheave clamps the rope between the sheave and shoe 18. Alternative mechanical means of constraining motion of sheave may be also employed without departing from the invention. Guide 16 and shoe 18 may alternatively be rotating rollers, but shown here are fixed deflection locations having low friction surfaces to keep the descender compact and to minimize cost.

Figure 3:
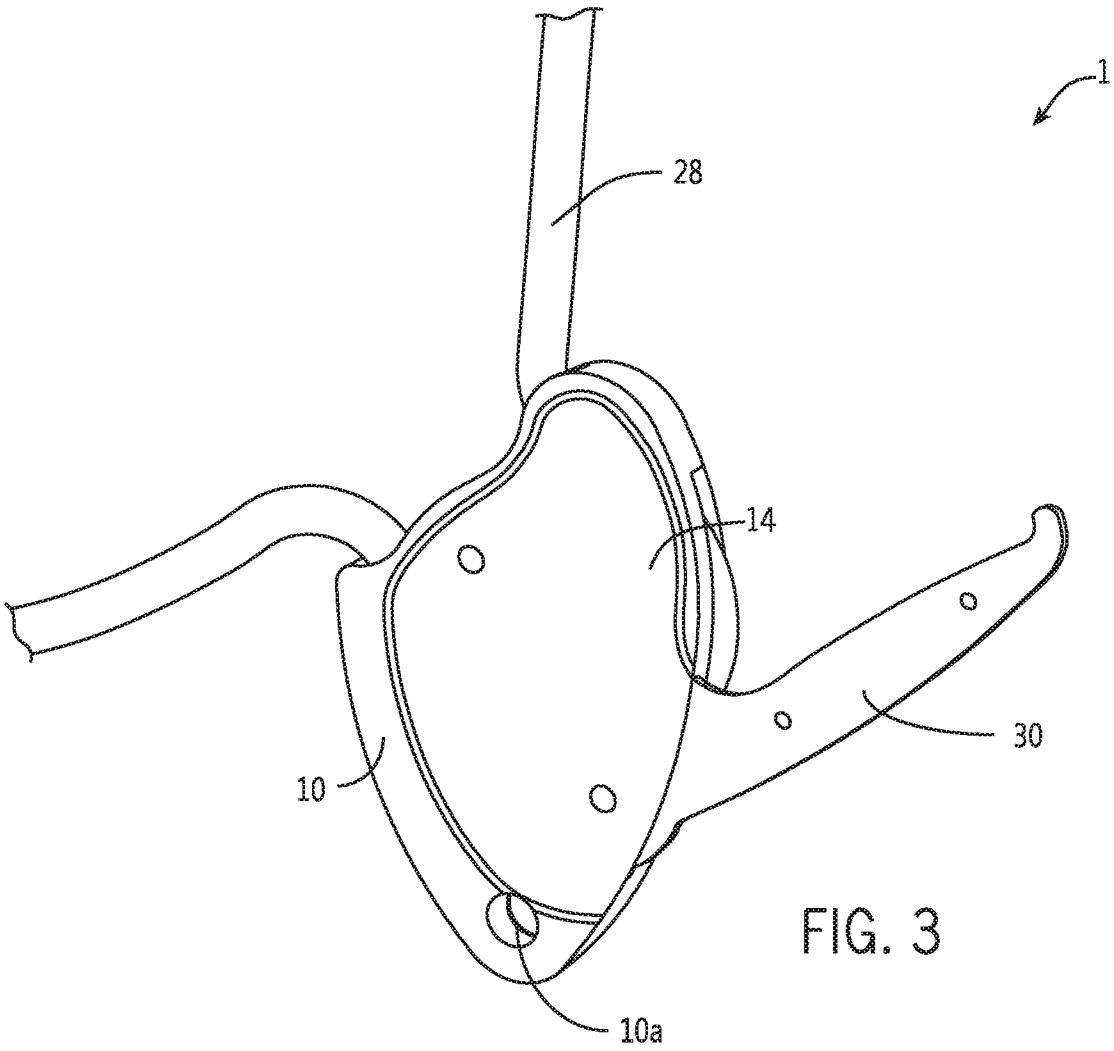
FIG. 3 is another perspective view of the descender of FIG. 1, showing the descender from the opposite direction as FIG. 1.
Figure 4:
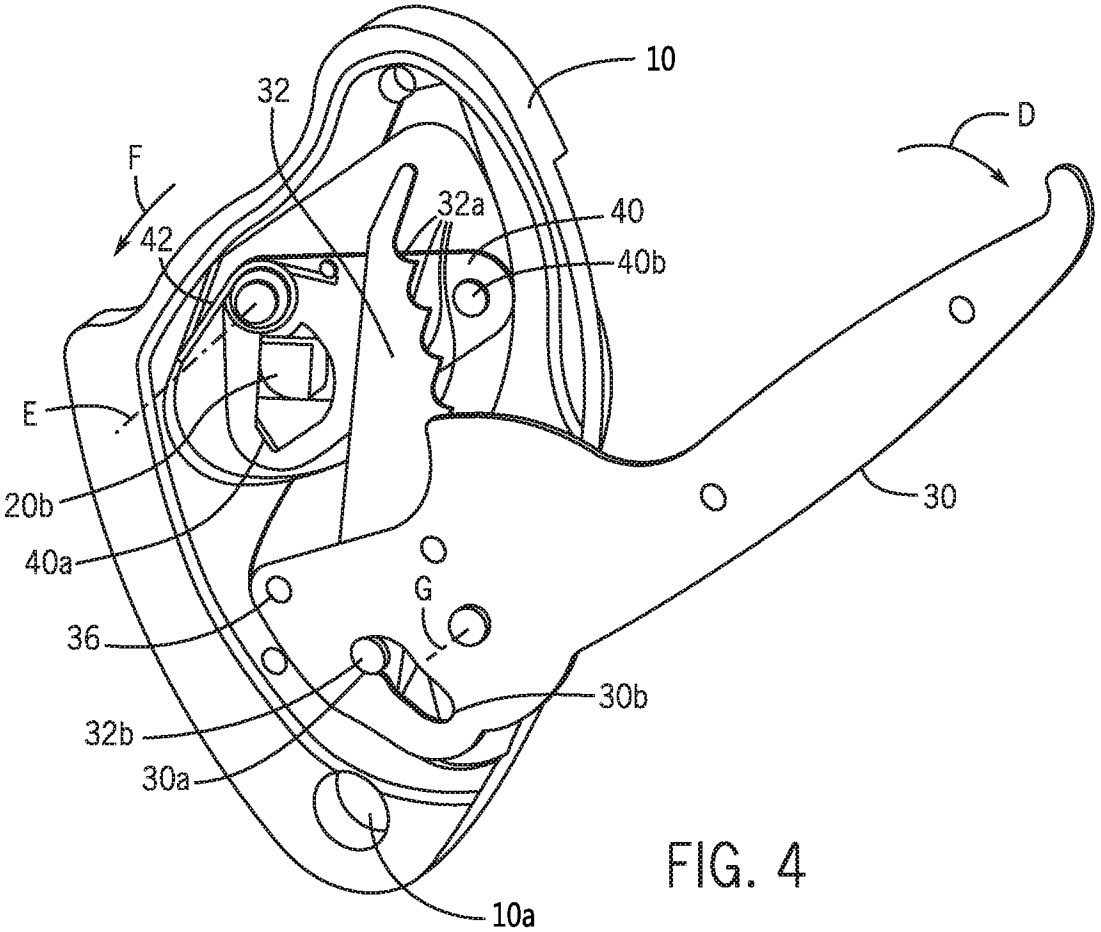
FIG. 4 is another perspective view of the descender of FIG. 1, showing a release mechanism cover removed to reveal internal components of the descender.
Figure 6:
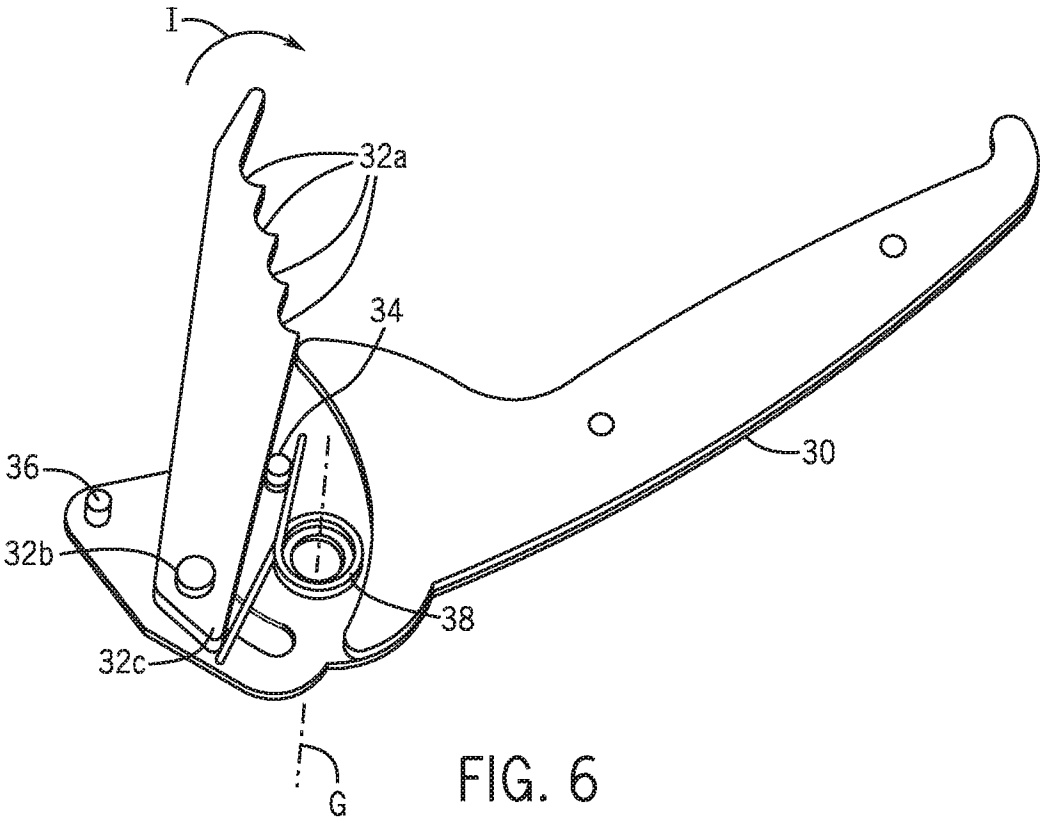
FIG. 6 is a perspective view of one embodiment of a handle subassembly in accordance with the invention showing one handle member removed.

As shown in FIG. 3, release mechanism cover 14 is attached to chassis 10 on the opposite side of swing plate 12 and provides pivot locations for components within the descender 1. FIG. 4 shows descender 1 with release mechanism cover 14 removed. Bellcrank 40, is attached to chassis 10 and pivots about axis E. Bellcrank opening 40*a* engages pivot arm boss 20*b*. Bellcrank 40 is rotatably attached to chassis 10. As shown in FIG. 4, bellcrank spring 42 biases bellcrank 40 in direction F, maintaining contact between bellcrank opening 40*a* and pivot arm boss 20*b*. Maintaining contact between bellcrank opening 40*a* and pivot arm boss 20*b* is critical because it ensures that the actuation of handle member 30 is reliably transferred to bellcrank 40. Handle member 30 pivots about axis G and may be actuated in direction D. Such actuation causes motion to be transmitted from selector link 32 to bellcrank 40, which transfers motion to pivot arm 20 and, ultimately, to sheave 22. As such, the actuation of handle member 30 causes the pivot arm 20 to pivot about axis J, thereby allowing a user to regulate clamping force between rope 28 and shoe 18. Regulating the clamping force between rope 28 and shoe 18 allows rope 28 to travel through the descender at varying load. Handle subassembly 31 pivots about axis G and, as shown in FIG. 6, is rotatably attached to selector link 32.

Figure 5:
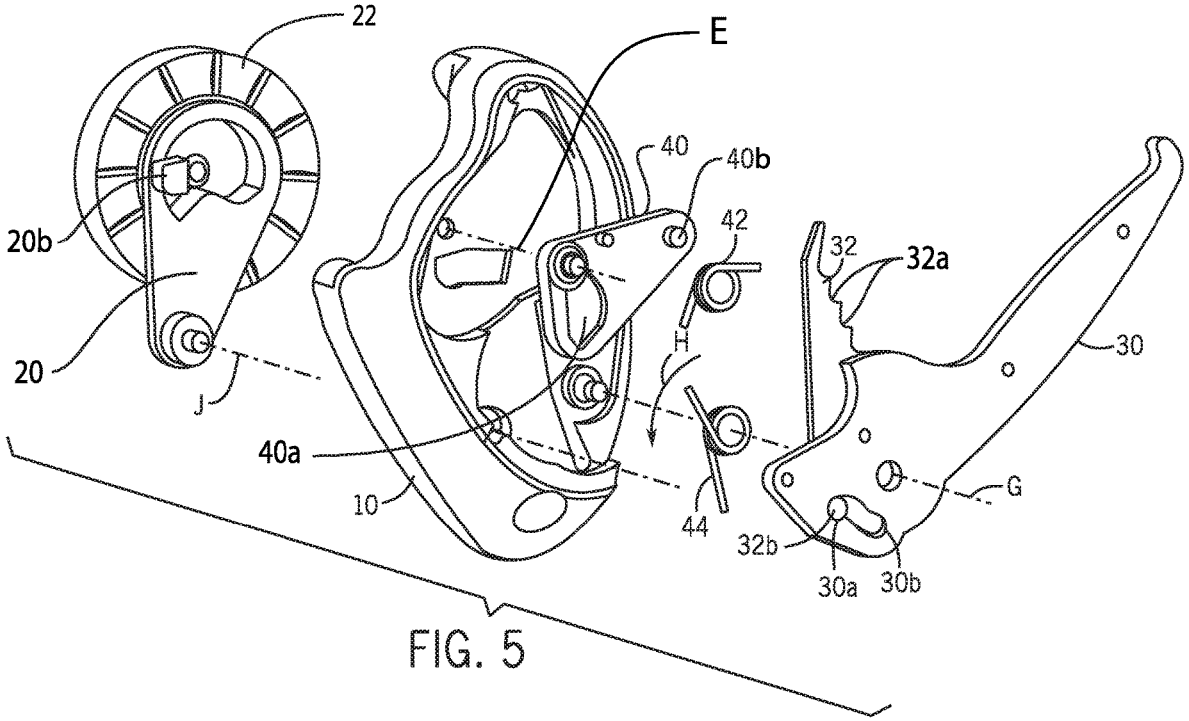
FIG. 5 is an exploded perspective view of the descender of FIG. 1, with release mechanism cover 14 removed.

As can be seen in FIG. 4, selector link 32 engages handle subassembly 31 via selector link pin 32*b*, which may move from a notch 30*a* to slot 30*b*. As shown in FIG. 5, handle spring 44 is positioned between handle subassembly 31 and chassis 10. Handle spring 44 engages handle spring pocket 43, which is formed in chassis 10 and handle subassembly 31. Handle spring 44 biases handle subassembly 31 and selector link 32 in rotational direction H about axis G. As can be seen in FIG. 6, selector link spring 38 engages selector link lobe 32*c*, and serves to both bias selector link pin 32*b* into the notch 30*a* and bias selector link 32 to rotate in direction I and against stop pin 34.

Referring back to FIGS. 1 and 2, when descender 1 is in use, a carabiner links through hole 10*a* to attach the descender to an operator's harness or any other suitable anchor point. As tension is applied to rope 28 in direction A, the aforementioned ratchet mechanism causes sheave 22 to resist rotation in the direction opposite of direction B. The resulting moment causes sheave 22 and pivot arm 20 to rotate in direction C about axis J, thereby clamping rope 28 between shoe 18 and sheave 22. As such, rope 28 is forced into groove 22*a* of sheave 22 by shoe 18, initiating holding forces and further driving rope 28 into the groove. Frictional forces between rope 28 and sheave 22 are great enough to resist motion of the rope in direction A. These relationships describe the self-energizing braking action that occurs as tension exists in rope 28 in direction A.

Controlled release of rope 28 is initiated by the operator pulling handle subassembly 31, pivoting said handle subassembly in direction D as shown in FIG. 4. As handle subassembly 31 rotates in direction D, so too does selector link 32 until one of notches 32*a* engages boss 40*b* of bellcrank 40, thereby rotating pivot arm 20 and sheave 22 in rotational direction opposite of direction C, thereby reducing the force on rope 28 between sheave 22 and shoe 18. Reduced force on rope 28 between sheave 22 and shoe 18 reduces the total frictional force applied to rope 28 by the descender, thereby allowing rope 28 to slip past the sheave. Regulation of the rate of slipping of rope 28 is achieved by the operator input to the handle, thereby regulating the clamping force on rope 28 between sheave 22 and shoe 18. A large mechanical advantage is achieved via the leverage of handle subassembly 31 to selector link 32, and from bellcrank 40 to pivot arm 20, which yields a high degree of control of descent with minimal operator effort applied to handle subassembly 31.

When holding rope 28 under load, certain conditions will affect the resting angular position of pivot arm 20 about axis J. Variations in rope diameter will affect the distance between sheave 22 and shoe 18. Likewise, different rope constructions may have different rates of compressibility, which will affect the distance between sheave 22 and shoe 18. Additionally, different magnitudes of load applied to the descender via the rope will result in different amounts of compression of the rope, which will affect the distance between sheave 22 and shoe 18. These variables introduce the reality of different angular positions of pivot arm 20 and sheave 22 about axis J for the same holding (no motion) condition. It follows that bellcrank 40 will also reside in different angular positions about axis E when holding the rope based on the same variables of rope diameter, construction, and tension. It also follows that, when in the state of holding the rope, boss 40*b* of bellcrank 40 may reside in different positions based on the variables of rope diameter, construction, and tension. As such, when the operator initiates release by rotating handle subassembly 31 with selector link 32 in direction D, selector link 32 will engage the most appropriate of notches 32*a* with boss 40*b* according to the position of bellcrank 40. The interaction between notches 32*a* and boss 40*b* provides the benefit of automatically adjusting the effective length of selector link 32 to the variables of rope diameter, construction, and tension. This feature ensures that the operator will experience similar handle subassembly 31 positions during the act of releasing the rope 28, regardless of rope diameter, construction, and tension.

If an operator inadvertently actuates handle subassembly 31 too far in direction D, travel of selector link 32 between the circular paths of selector link pin 32*b* and boss 40*b* will reach a position where selector link 32 will contact panic trigger pin 36. Continuation of handle motion in direction D past this position will cause selector link pin 32*b* to become dislodged from a notch 30*a* in handle subassembly 31, and selector link pin will overcome selector link spring 38, traveling into slot 30*b* in handle subassembly 31. The result is that handle subassembly 31 is unable to drive selector link 32, so bellcrank 40 counter rotates on axis F resuming the clamping force on rope 28 between sheave 22 and shoe 18, allowing sheave 22 to resume holding of rope 28. Release of handle subassembly 31 by the operator will enable handle spring 44 to rotate handle subassembly 31 in direction H to the starting position of the handle, and allows selector link spring 38 to return selector link pin 32*b* to a notch 30*a*, thereby resetting the handle mechanism and making it again ready to initiate release.

Figure 7:
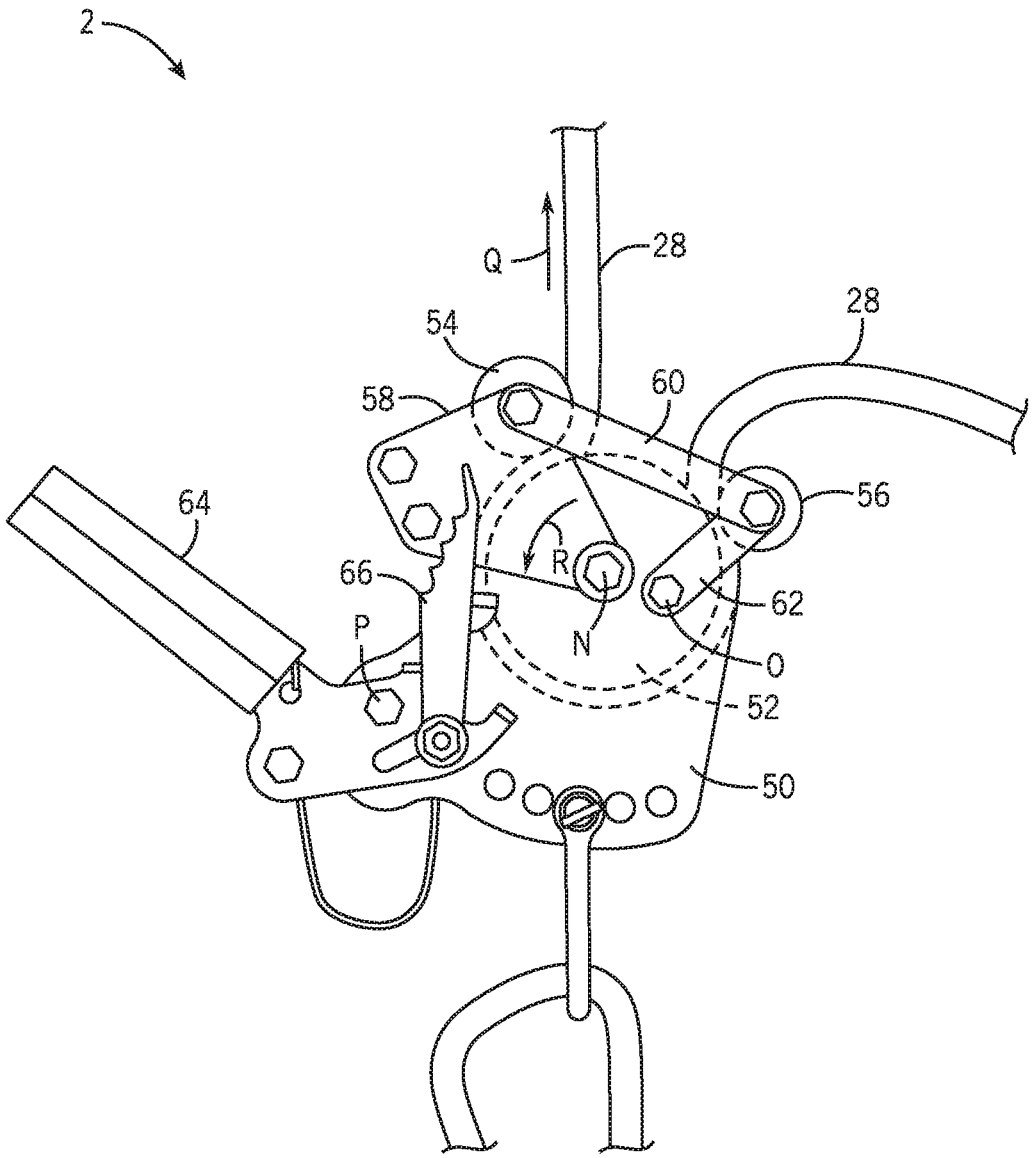
FIG. 7 is a perspective view of an alternative embodiment of a descender in accordance with the invention.

In an alternative embodiment of a descender 2 in accordance with the invention shown in FIG. 7, a sheave 52 is rotatably mounted to a chassis 50, with guide 54 and shoe roller 56 mounted on a first link 58 which constrains motion but allows the guide and the shoe roller to translate relative to the chassis and sheave. In the embodiment shown, sheave 52 may only rotate in direction R. Guide 54 is mounted to first link 58, which pivots about axis N. Guide 54 is linked to shoe roller 56 via second link 60. Shoe roller 56 is mounted to third link 62 and pivots about axis O. As tension is applied to rope 28 in direction Q, guide 54 is forced in direction R about axis N, forcing shoe roller 56 against rope 28, which forces the rope into a groove in sheave 52, initiating holding forces and further driving rope 28 into groove of sheave 52. Frictional forces between rope 28 and sheave 52 are great enough to resist motion of rope 28 in direction Q. These relationships describe the self-energizing braking action that occurs as tension exists in rope 28 in direction Q. Handle 64 rotates about axis P and operates in conjunction with selector link 66 in a manner comparable to handle subassembly 31 and selector link 32 in the preferred embodiment.

Figure 8:
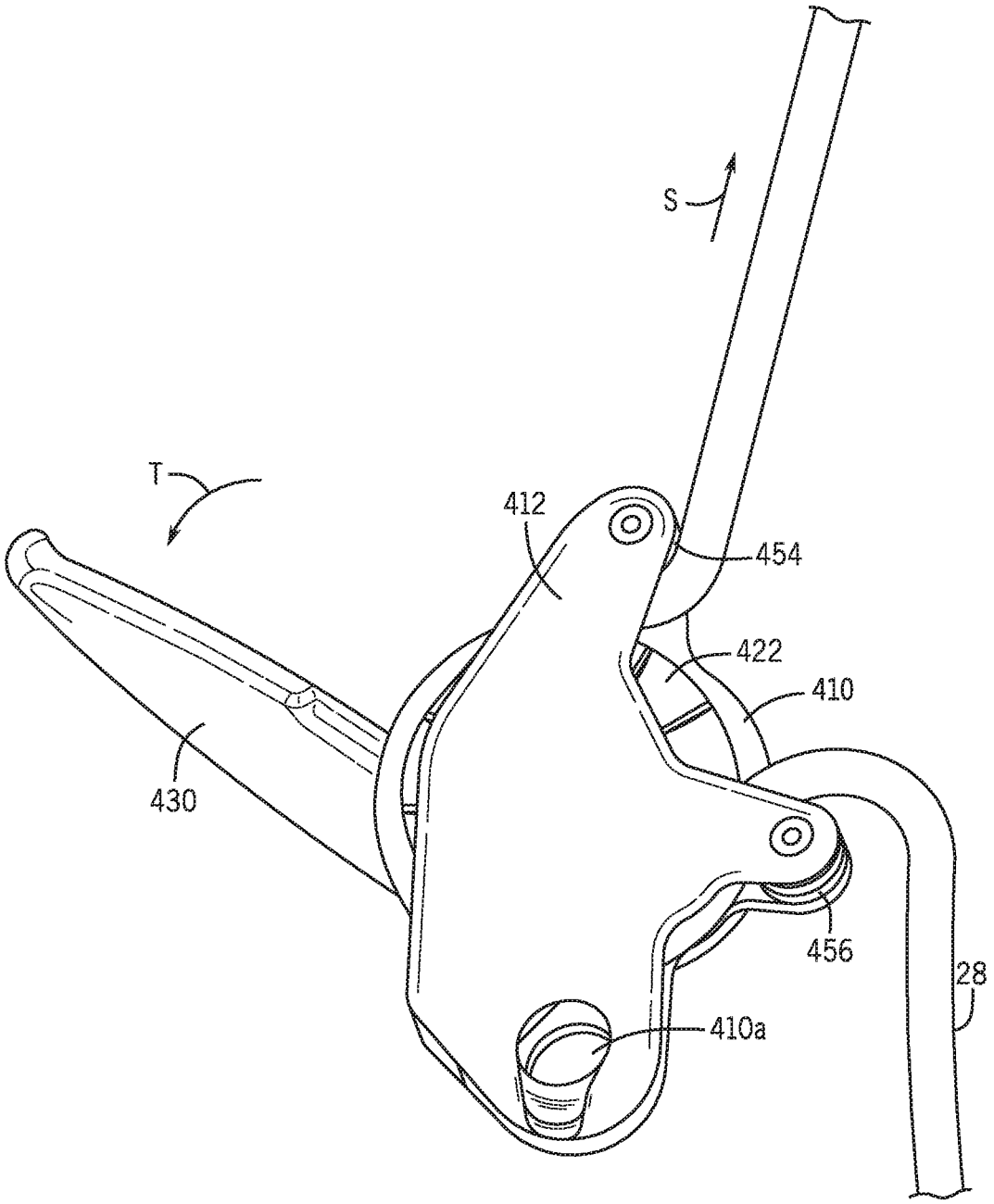
FIG. 8 is a perspective view of an additional alternative embodiment of a descender in accordance with the invention having an alternative cam release mechanism and showing a rope installed as it would be seen by an operator in use.
Figure 9:
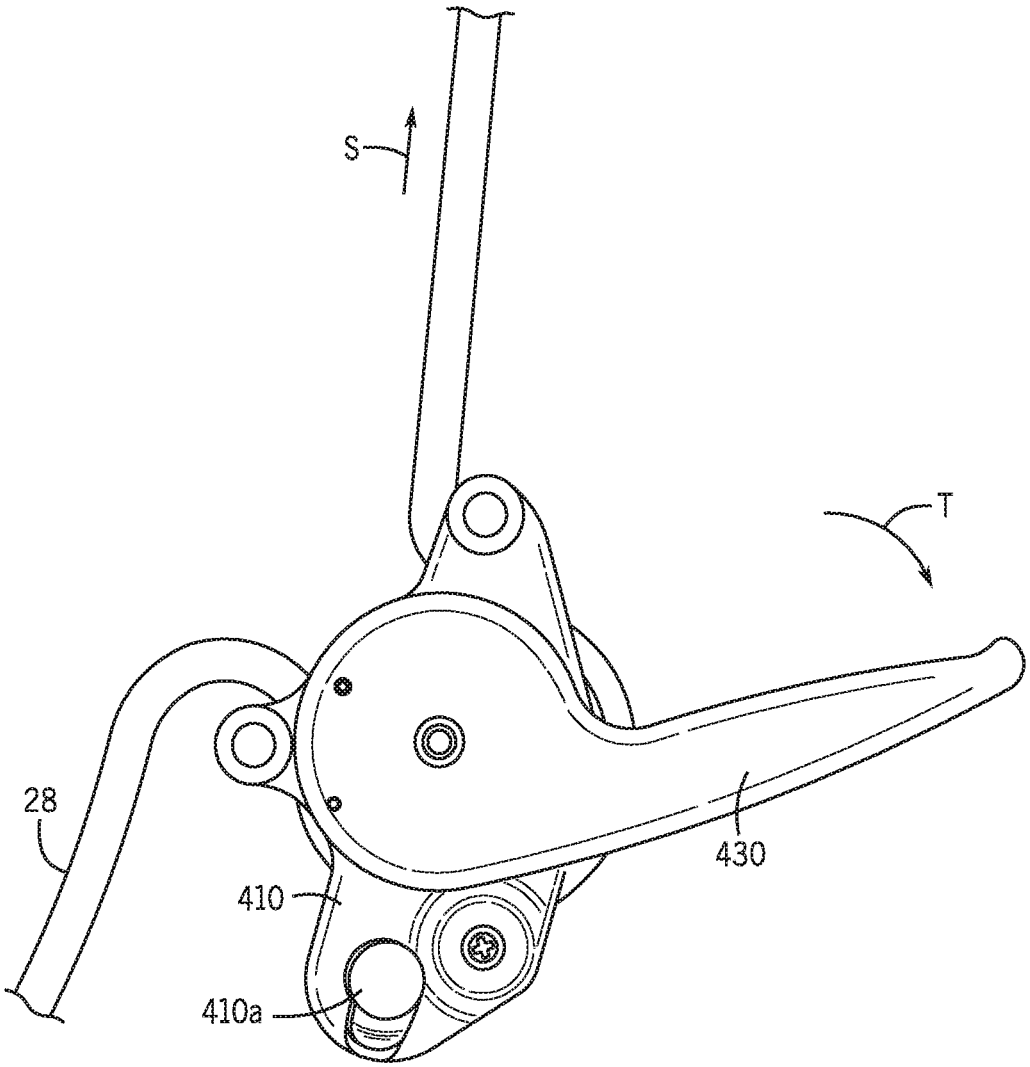
FIG. 9 is another perspective view of the descender of FIG. 8 showing the opposite side of the descender.

An alternative embodiment of a descender 3 in accordance with the invention is shown in FIG. 8 and includes a chassis 410, which together with opening plate 412, contains rope 28. Rope 28 is reeved such that the load to be managed pulls in direction S. Hole 410*a* provides a means of attachment, typically accomplished with a carabiner although any suitable means of attachment may also be used. Handle 430 is pivotally mounted to chassis 410, and control of the rope through the descender is achieved by an operator rotating the handle in direction T.

Figure 14:
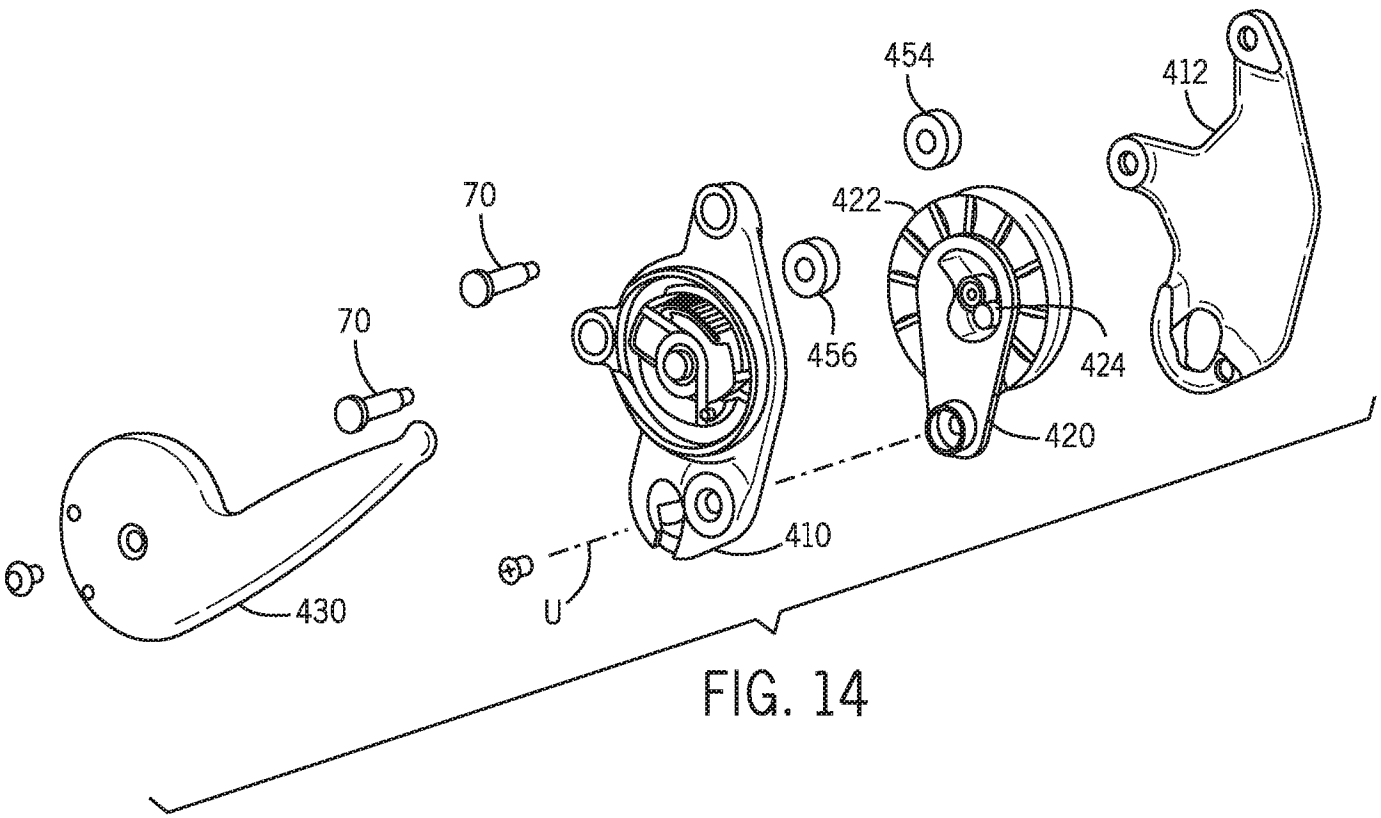
FIG. 14 is a partially exploded perspective view of the descender of FIG. 8.
Figure 15:
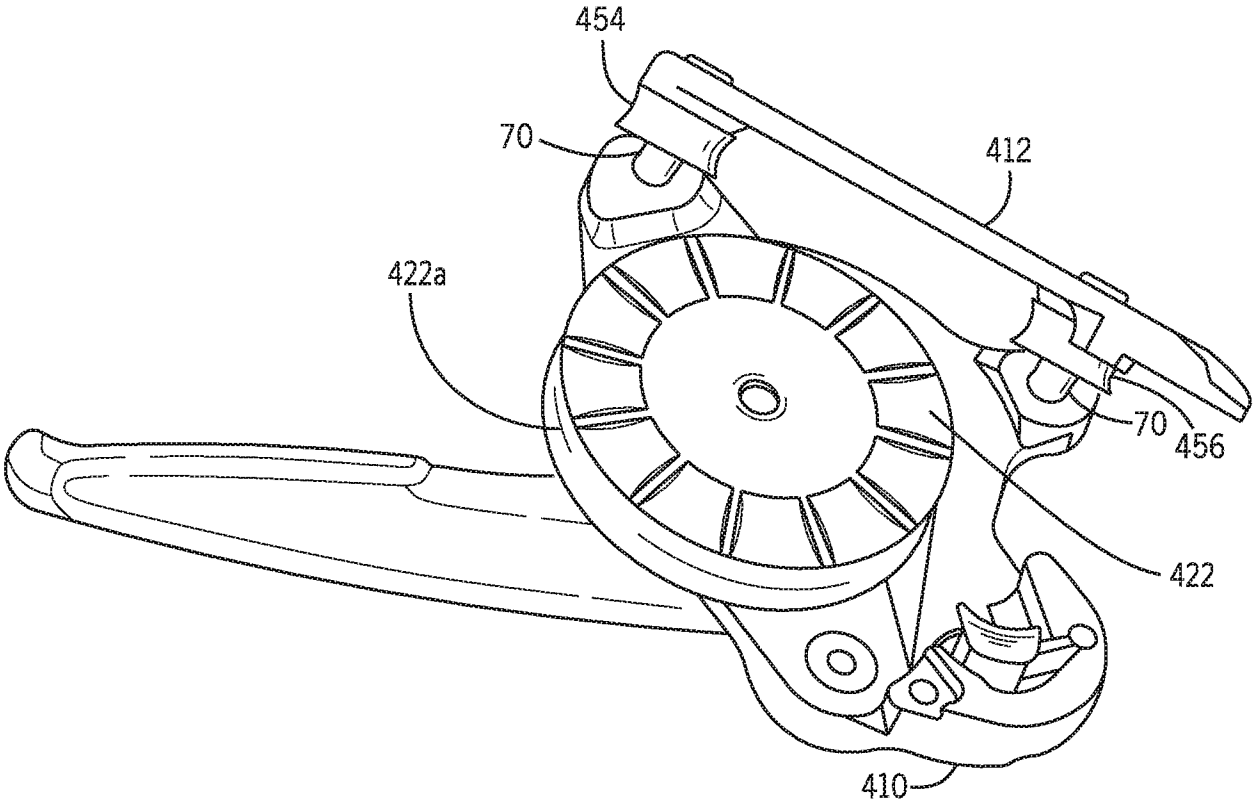
FIG. 15 is a perspective view of the descender of FIG. 8 shown in an open position.

The means of gripping the rope in this embodiment is substantially similar to the device shown in FIG. 1 and described above. The rope 28 is captured between sheave 422 and rollers 454 and 456. Although rollers 454 and 456 are shown, any suitable bearing surface may be used without departing from the invention. As shown in FIG. 14, pivot arm 420 supports sheave 422 and is rotatably attached to chassis 410 such that the pivot arm can move about axis U. Applying tension to rope 28 in direction S results in translation of sheave 422 toward roller 456, which forces rope 28 into a groove 422*a* of sheave 422. As the tension on rope 28 increases, so does the force moving sheave 422 toward roller 456. As with the device shown in FIG. 1, frictional forces between rope 28 and sheave 422 are great enough to resist motion of rope 28 in direction S.

As shown in FIGS. 10-13, a pivot arm roller 424 is attached to pivot arm 420 and extends into opening 428. A cam 90 is rotatably attached to the chassis 410 and can rotate about boss 426. Cam spring 91 forces cam 90 in direction T relative to chassis 410, initiating and maintaining contact between cam surface 90*a* and pivot arm roller 424. Handle 430 contains handle pawl 80 which is rotatably mounted to the handle about axis W. Handle pawl spring 81 engages with handle pawl 80 and biases it in direction X about axis W. Handle pawl 80 includes handle pawl teeth 80*a* and handle pawl tail 80*b*. Boss 432 protrudes from handle 430 and serves to limit angular rotation of handle 430 when assembled.

Figure 10:
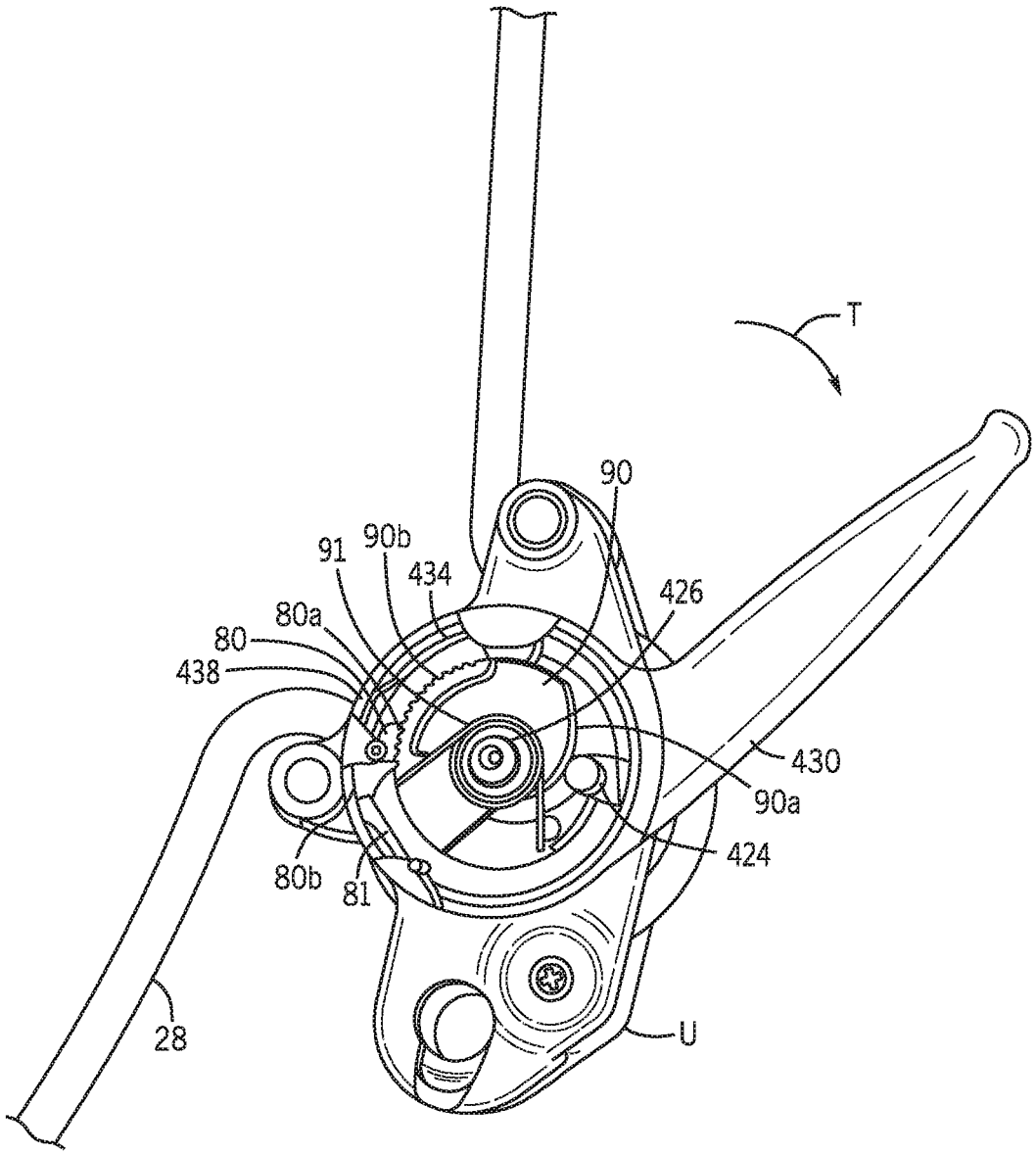
FIG. 10 is a perspective view of the descender of FIG. 9 with a portion of a handle removed to reveal internal components.
Figure 11:
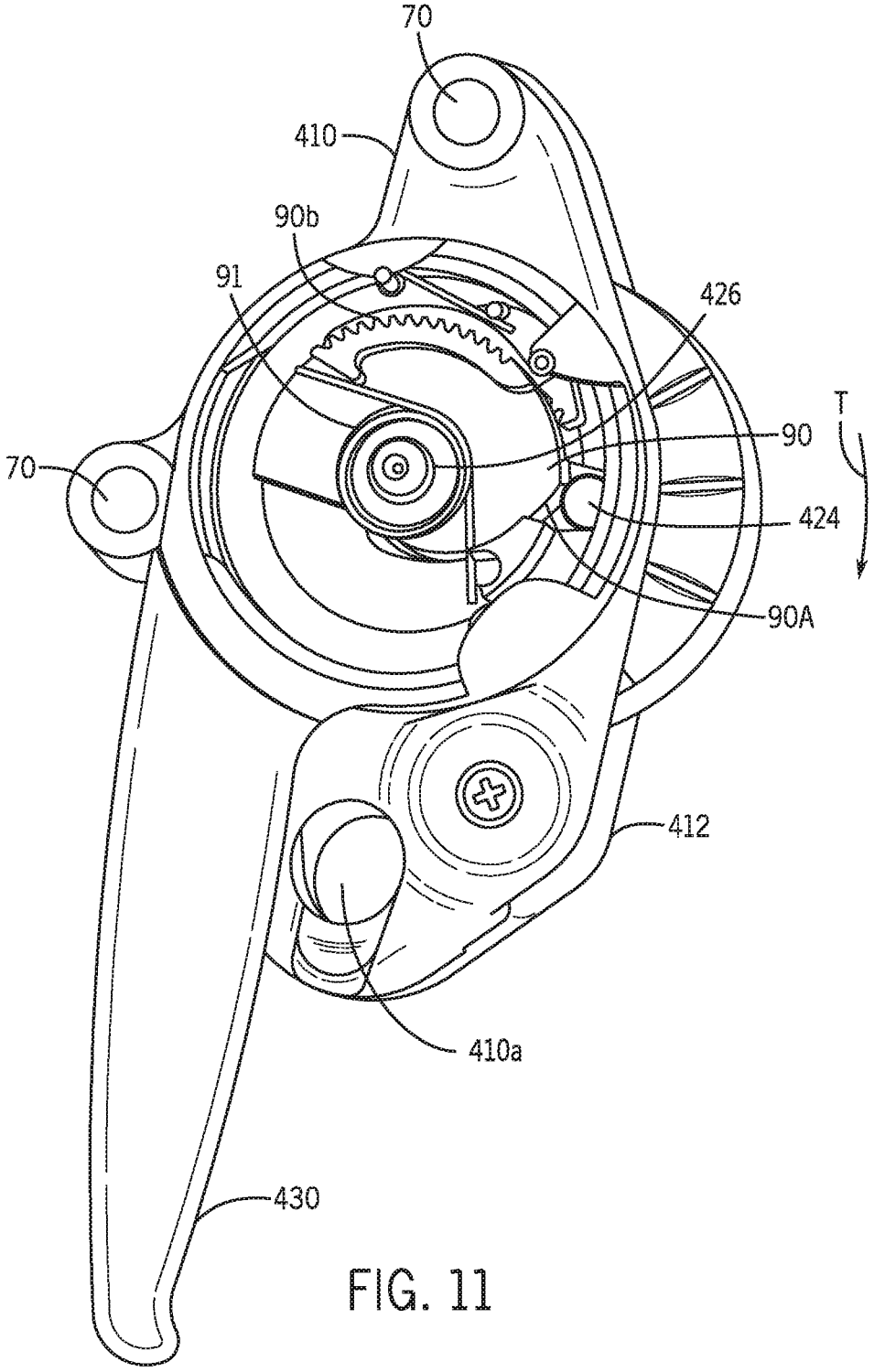
FIG. 11 is another perspective view of the descender of FIG. 9 with the rope removed and the handle in a stowed position.
Figure 12:
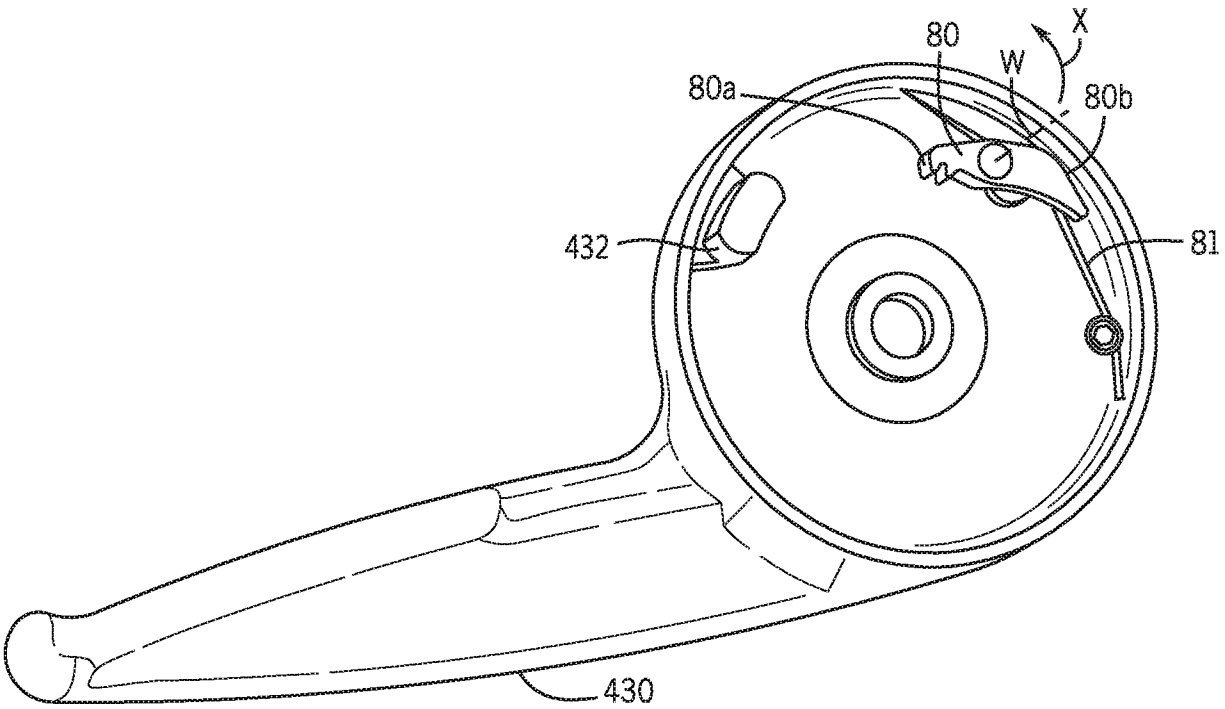
FIG. 12 is a perspective view of a handle for the descender of FIG. 8 showing the internal components of the handle.
Figure 13:
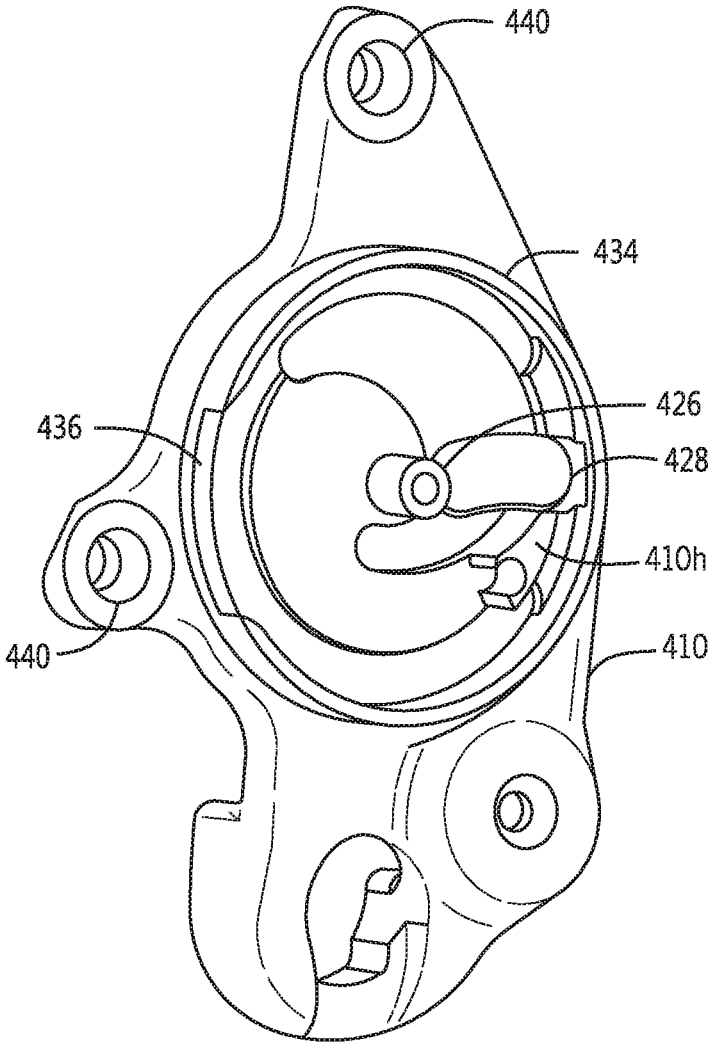
FIG. 13 is a perspective view of a chassis for the descender of FIG. 8.

FIG. 13 shows a control ring 434 and control ring aperture 436 of chassis 410. As seen in FIG. 10, handle 430 pivots about boss 426 of chassis 410. Handle pawl 80 engages control ring 434 to control which positions of handle 430 will allow handle pawl teeth 80*a* to mesh with cam teeth 90*b*. FIG. 11 shows handle 430 in a stowed position, i.e. positioning handle 430 such that handle pawl tail 80*b* contacts control ring 434, which causes handle pawl 80 to rotate, thereby providing clearance between handle pawl teeth 80*a* and cam 90. FIG. 10 shows handle 430 in an operable position, i.e. positioning handle 430 in an angular position such that handle pawl tail 80*b* is positioned in aperture 436, handle pawl spring 81 causes handle pawl 80 to rotate in direction X about axis W, thereby making handle pawl teeth 80*a* available to engage cam 90.

Handle 430 may be rotated in direction T from the stowed position shown in FIG. 11 to the operable position shown in FIG. 10. As previously explained, aperture 436 of chassis 410 enables handle pawl teeth 80*a* to engage with cam teeth 90*a*. Meshing handle pawl teeth 80*a* with cam teeth 90*b* links the motion of handle 430 and cam 90 while handle pawl tail 80*b* of handle pawl 80 is positioned in control ring aperture 436. From the handle operable position, controlled release of rope 28 is achieved by the operator pulling handle 430 in direction T, which rotates cam 90 in the same direction. Contact between cam 90 and pivot arm 420 via cam surface 90*a* and pivot arm roller 424 causes pivot arm 420 and sheave 422 to rotate about axis U, thereby reducing the force on rope 28 between sheave 422 and roller 456. Reducing the force applied to rope 28 between sheave 422 and roller 456 reduces the total frictional force between the rope and the descender 3, allowing rope 28 to slip past the sheave 422.

Cam 90 will also reside in different angular positions depending on the angle of pivot arm roller 424 in relation to cam surface 90*a*. The plurality of cam teeth 90*b* allows the descender 3 to adapt to variations in rope diameter, construction, and tension in the same way that the multiple notches of the selector link does in the first embodiment described above. This release mechanism allows the handle 430 to rotate much further than previous descenders, making it possible to create a "stowed" position where the handle is out of the way when not needed for release.

Using cam 90 to achieve the mechanical advantage required for controlled release of rope 28 allows the mechanical advantage to be easily tuned and optimized for the magnitude of force applied to the rope—the highest loads typically equate to the furthest rotation of the cam, and the corresponding area of the cam surface can be made more gradual to provide greater mechanical advantage. The teeth of the handle pawl and cam allow for much finer resolution of the adaptive release, which maximizes the release travel better than what was possible with the selector link of the first embodiment. Another advantage of this design is that it is very easy to incorporate the panic locking function. By controlling the size and location of the aperture 436, the handle can be disconnected from the cam if the handle is swung too far because handle pawl tail 80*b* will come in contact with control ring 434, rotating handle pawl 80 and disengaging handle pawl teeth 80*a* from cam teeth 90*b*.

Figure 16:
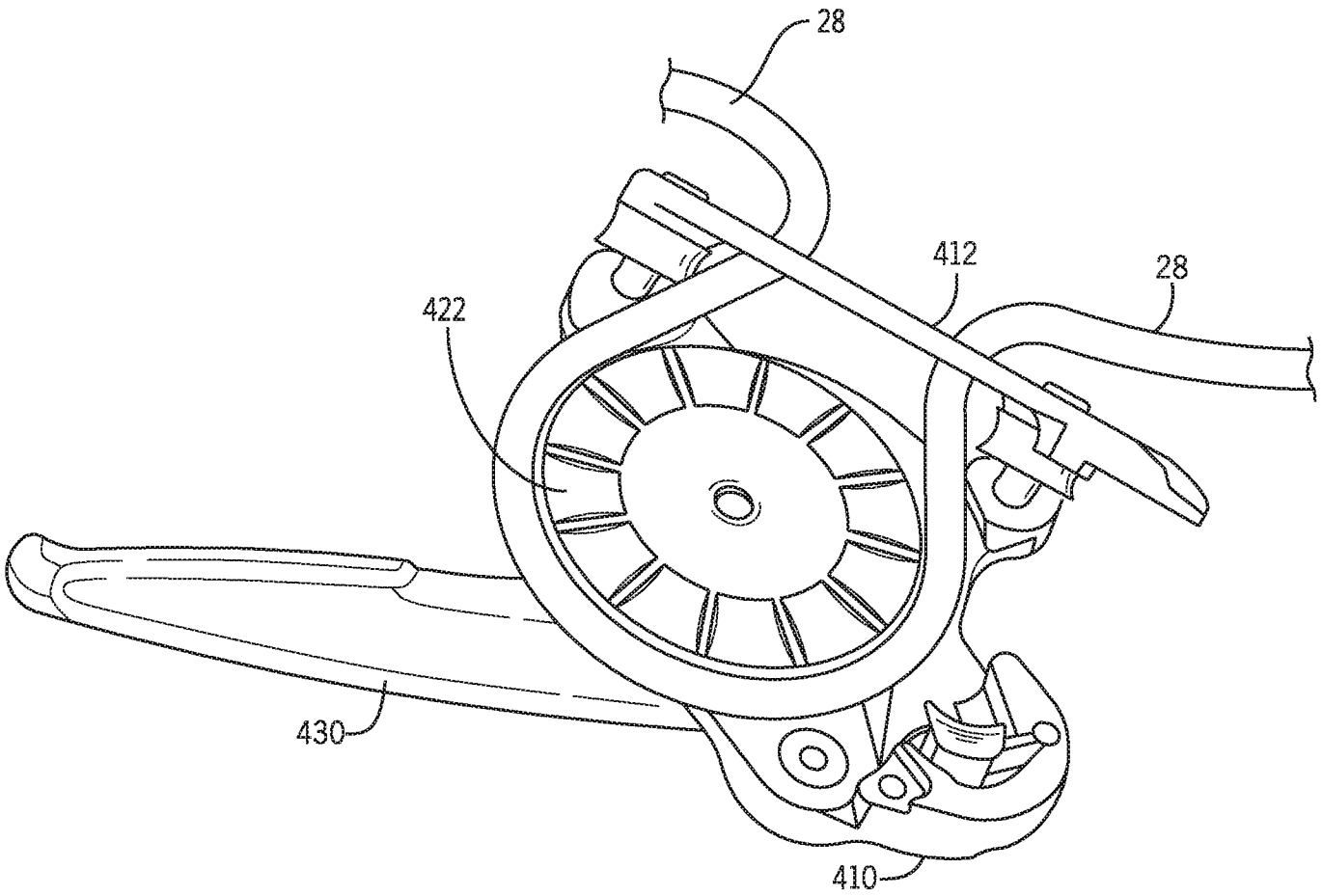
FIG. 16 is another perspective view of the descender of FIG. 8 shown in an open position and further demonstrating how the descender can be rigged.
Figure 18:
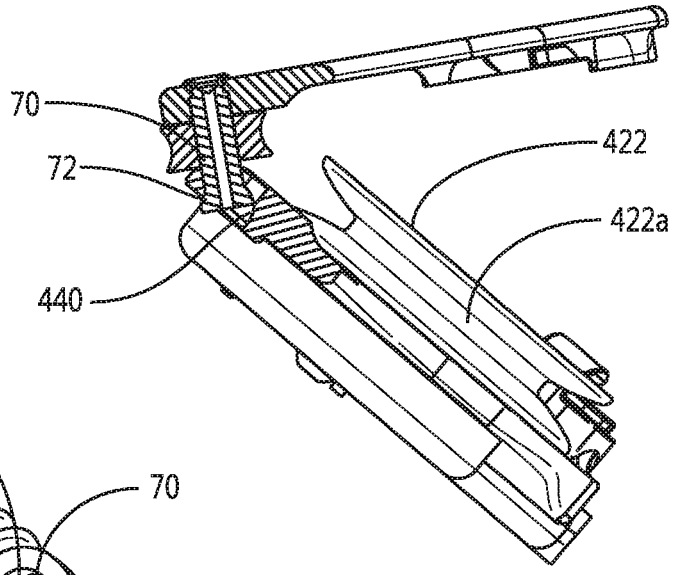
FIG. 18 is a section view of the descender of FIG. 8 taken generally along the line 18-18 in FIG. 17.
Figure 17:
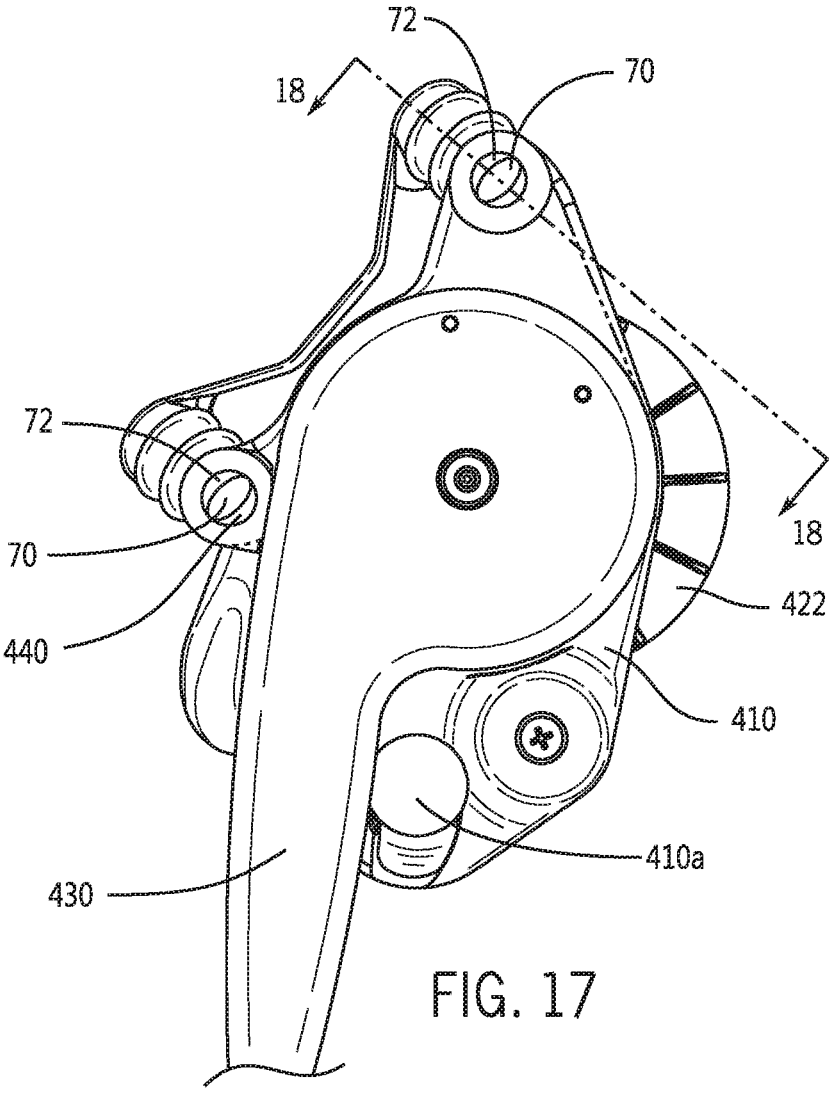
FIG. 17 is a perspective view of the descender of FIG. 8 showing the descender in an open position.
Figure 20:
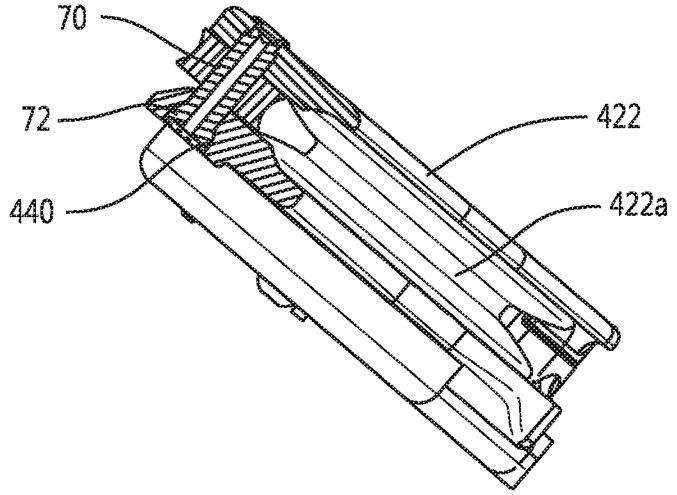
FIG. 20 is a section view of the descender of FIG. 8 taken generally along the line 20-20 in FIG. 19.
Figure 19:
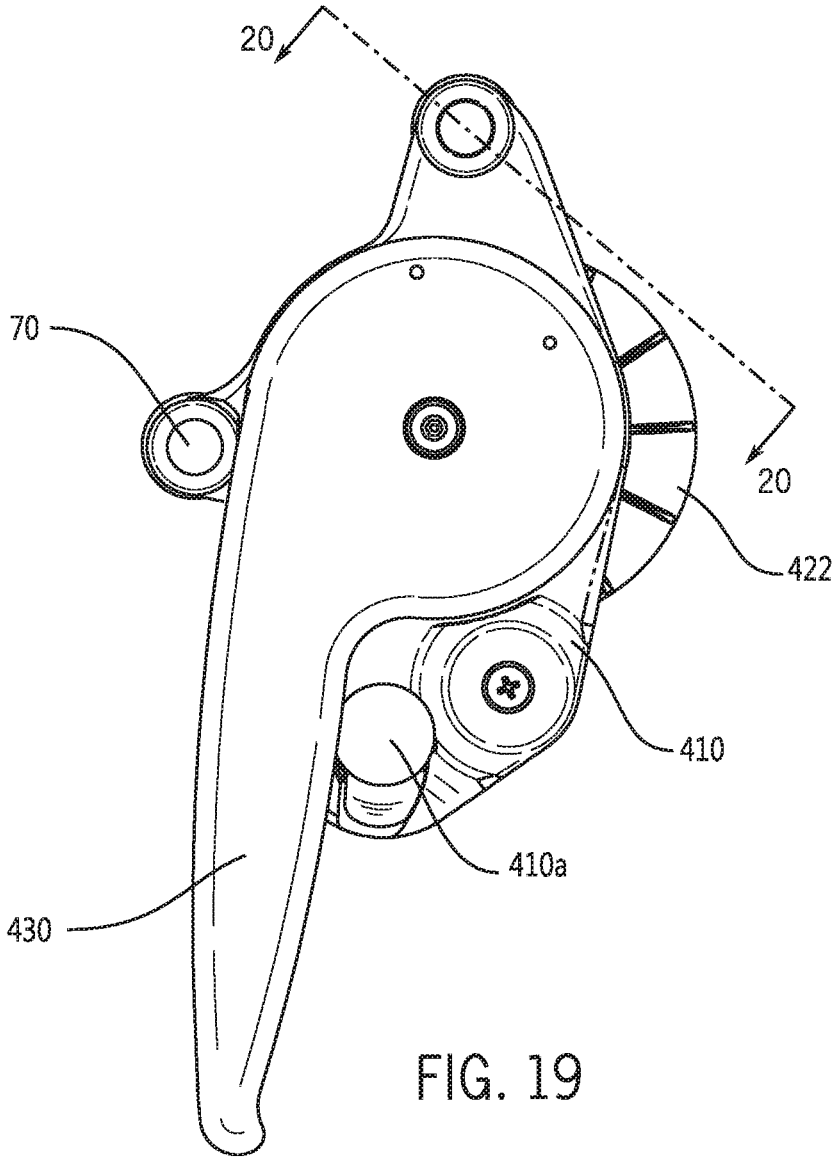
FIG. 19 is a side view of the descender of FIG. 8.

As shown in FIGS. 15-20, opening plate 412 is hinged about the ends of roller pins 70 such that opening plate 412 opens relative to chassis 410. In the embodiment shown, rollers 454 and 456 are attached to opening plate 412. Roller pins 70 include spherical heads 72 (see FIG. 18) that engage sockets 440 shown in FIG. 13. Other means of articulation including but not limited to pinned joints may alternatively be used without departing from the invention. With opening plate 412 fully opened, the space between chassis 410, opening plate 412, and rollers 454 and 456 is large enough to enable a bight of rope to be inserted and guided about sheave 422 as shown in FIG. 16. This simplified approach to rigging greatly reduces the likelihood of an operator incorrectly rigging the descender 3 and causing an unsafe condition. The carabiner used to attach the descender through hole 410*a* maintains closure of the plates when the unit is under load. Additional latches and/or magnets may be also be used to enhance the security of closure.

Although the invention has been herein described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter of the appended claims and the description of the invention herein.

What is claimed is:

1. A descender for controlling descent of a load along a rope; the descender comprising:

a chassis with a first end of a pivot arm pivotably attached thereto, wherein a control ring and control ring aperture are integrally formed into the chassis;

an opening plate movably attached to the chassis, the opening plate movable between an open and a closed position;

a generally circular sheave, the sheave having a circumference, the circumference including a groove;

the generally circular sheave rotatably attached to a second end of the pivot arm;

a guide and a shoe, each of the guide and the shoe attached to the chassis and positioned on substantially opposite sides of the sheave, the sheave positioned a variable distance between the guide and the shoe, such that when the opening plate is in the open position, the rope is installed by inserting the rope past the guide, around at least a substantial portion of the circumference of the sheave, and past the shoe;

when the opening plate is in the closed position, a secure path for the rope is formed, the secure path allowing the rope to slide against the guide and the shoe, and to be selectively forced into the groove;

the second end of the pivot arm biased away from the shoe;

a handle including a pawl having teeth and a tail;

a cam rotatably mounted to the chassis;

the teeth selectively engaged with the cam;

the cam engaged with the pivot arm;

the handle configured to move to control the variable distance between the sheave and the shoe; and the handle configured to rotate to a stowed position such that the tail contacts the control ring, which causes the pawl to rotate and disengage from the cam.

2. The descender of claim 1, wherein the sheave can freely rotate in only one direction.

3. The descender of claim 1, further comprising:

a cam spring forcing the cam toward a pivot arm roller.

4. The descender of claim 1, wherein the guide is a roller that can freely rotate.

5. The descender of claim 1, wherein the shoe is a roller that can freely rotate.

6. The descender of claim 1, wherein a spring biases the pivot arm away from the shoe.

7. The descender of claim 1, wherein the sheave does not rotate during descent, but can freely rotate during ascent.

8. The descender of claim 1, further including an attachment hole passing through the chassis and opening plate such that when the opening plate is in the closed position, an operator can lock the descender in the closed position.

* * * * *